US006249220B1

(12) United States Patent
Kaji et al.

(10) Patent No.: US 6,249,220 B1
(45) Date of Patent: Jun. 19, 2001

(54) DETECTED INFORMATION DISPLAY SYSTEM IN FIRE DETECTING SYSTEM

(75) Inventors: Yukiko Kaji, Tokyo; Mitsuhiro Kurimoto, Machida; Kiyoaki Koyama, Sagamihara; Hiroyuki Tatsuno, Hachioji; Naoya Matsuoka, Machida; Kumiko Ando, Yamato, all of (JP)

(73) Assignee: Hochiki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/447,364

(22) Filed: Nov. 23, 1999

(30) Foreign Application Priority Data

Nov. 30, 1998 (JP) ..... 10-355356

(51) Int. Cl.[7] ..... G08B 29/00

(52) U.S. Cl. ..... 340/511; 340/506; 340/533; 340/524; 340/525

(58) Field of Search ..... 340/506, 511, 340/531, 532, 533, 524, 525

(56) References Cited

U.S. PATENT DOCUMENTS 5,400,246 * 3/1995 Wilson et al. ..... 340/825.06 X

* cited by examiner

*Primary Examiner*—Daryl Pope
(74) *Attorney, Agent, or Firm*—Lackenbach Siegel Marzullo Aronson & Greenspan

(57) ABSTRACT

A detected information display system in a fire detecting system of the present invention which is equipped with detectors arranged in a warning area and a control panel and achieves a specified information display on a physical quantity detected by the detectors, includes a secondary conversion part to convert the physical quantity detected by the detector to the specified level, a conversion level storage part to store the converted level, an extraction part to extract the maximum level from the levels stored in the conversion level storage part, and a display part which is equipped with level display parts, and keeps the level display part corresponding to the converted level and the level display part corresponding to the maximum extracted level in a visually different condition from each other. The maximum detected physical quantity and the set value to indicate the abnormal level can be rapidly grasped, and the displays of a plurality of detectors can be displayed in an integrated and related manner.

8 Claims, 6 Drawing Sheets

DETECTED INFORMATION DISPLAY SYSTEM IN FIRE DETECTING SYSTEM

BACKGROUND OF THE INVENTION

1. Field of the Invention

The present invention relates to a detected information display system in a fire detecting system for displaying a specified information on the physical quantity detected by a sensor in the fire detecting system provided with the sensor and a control panel to control the sensor.

2. Description of the Related Art

A smoke detection system using a sampling tube is proposed to detect a fire in a high ventilation space such as a clean room and a radio room. In this system, the long sampling tube with a plurality of suction holes formed therein is installed in a warning area to be monitored, the air in the warning area is sucked through this sampling tube, and the smoke concentration of the sucked air and the air-flow speed are detected by a smoke detector and an air-flow detector provided in the vicinity of a base end part of the sampling tube. Generally, a plurality of sampling tubes are provided, and a plurality of smoke detectors and a plurality of air-flow detectors are respectively provided corresponding thereto. These smoke detectors and air-flow detectors are controlled by a control panel.

This control panel has been conventionally equipped with a display part to display the detected results or the like of the smoke detectors and air-flow detectors. FIG. 9 is a front view of the control panel in a conventional fire alarm system, and FIG. 10 is an expanded front view of the display part of the control panel of FIG. 9. As illustrated in FIG. 9, a plurality of (six in FIG. 9) display parts 101 corresponding to the number of the detectors are provided on a conventional control panel 100 independently from each other. Each display part 101 is equipped with ten LEDs 110–119 to display the smoke concentration detected by the smoke detectors as either level of 1 to 10, three LEDs 120 to 122 to display that the level of the smoke concentration exceeds the specified level, and one LED 123 to display an abnormality in the air-flow speed.

In such a conventional display part, when the smoke concentration detected by the smoke detectors is converted to either level corresponding to the detected smoke concentration out of the specified ten levels by the conversion part not indicated in the figure (this level is referred to as the "concentration level" as necessary), the LED corresponding to the converted concentration level out of the LEDs 110 to 119, and all LEDs corresponding to the concentration level lower than the converted concentration level (all LEDs located lower than the LED corresponding to the converted concentration level) are lit. For example, if the converted concentration level is 5, the LEDs 110 to 114 are lit. The conversion of the concentration level and the lighting of the LEDs are instantaneously updated every time the output is received from the smoke detectors, and constantly real-time processed. Three concentration levels are inputted in advance as the thresholds to judge three conditions of "CAUTION", "WARNING" and "ABNORMAL" (these three conditions are referred to as the "alarm conditions" as necessary) to the concentration level through an input part not indicated in the figure, and every time the concentration level is converted, a judgment part judges whether or not the concentration level exceeds the threshold. For example, when the concentration levels 5, 8 and 10 are set as the thresholds (each corresponding to the levels of "CAUTION", "WARNING" and "ABNORMAL"), the condition is judged to be "CAUTION" if the converted concentration level is 6.

When the concentration level is thus judged to fall into an alarm condition, the LED corresponding to the applicable condition out of three LEDs 120 to 122 is lit. For example, in the condition of "CAUTION", the LED 120 is lit. In the condition of "WARNING", the LED 121 is lit, and in the condition of "ABNORMAL", the LED 122 is lit. Though the lighting condition of these LEDs 120 to 122 is kept until a reset switch is depressed, the lighting of the LEDs 110 to 119 is constantly real-time updated, and for example, if the concentration level is temporarily 6 and then, changed to 3, the LED 120 is continuously lit, while only the LED 112 and the LEDs 110 to 111 located therebelow are lit as for the concentration level.

When the threshold is confirmed, a confirmation button 124 is depressed, and only while the confirmation button 124 is depressed, only the LED corresponding to the concentration level set as the threshold out of the LEDs 110 to 119 is lit. For example, if the concentration levels 5, 8 and 10 are set as the thresholds, only the LEDs 114, 117 and 119 are lit. It can be confirmed by this lighting that the concentration levels 5, 8 and 10 are respectively "CAUTION", "WARNING" and "ABNORMAL". While confirming the setting, the concentration level under detection now is not displayed. The air-flow speed detected by the air-flow detectors is constantly compared with the air-flow speed range preset as the threshold (i.e., the speed range deemed normal), and when the detected air-flow speed exceeds the air-flow speed range, the LED 123 is lit to display the abnormal air-flow speed.

There were, however, various problems in the conventional detected information display system in such a fire detecting system.

Firstly, the concentration level has been simply displayed in a constantly real-time manner as described above, and when the concentration level temporarily leads to the threshold, and then, dropped to the concentration level lower than the threshold, only the concentration level after the drop is displayed by the LEDs 110 to 119 though the LEDs 120 to 122 to indicate the alarm condition are lit, and the concentration level when an abnormal condition is generated, could not be grasped. Similarly, the maximum level out of the detected concentration levels in monitoring a fire could not be grasped, and when the concentration level 7 is detected under the condition where the threshold of the "CAUTION" condition is the concentration level 5, and the threshold of the "WARNING" condition is the concentration level 8, only the "CAUTION" condition has been displayed though there is a tendency leading to not only the "CAUTION" condition but also to the "WARNING" condition. Thus, it has been difficult to predict the tendency of the smoke concentration in advance and to take an action in an early stage by the monitoring service man.

Further, in the conventional detected information display system, it was necessary to depress the confirmation button 124 in confirming the threshold as described above, and it took time to confirm the threshold. In addition, the present concentration level is not displayed while the threshold is displayed, and there was a problem that the concentration level can not be temporarily grasped.

Still further, in the conventional detected information display system, the display of a plurality of detectors are made on another display part 101 as illustrated in FIG. 9, the condition of all detectors could not be grasped unless the eyes are extensively moved, resulting in an inconvenience that the situation can not be grasped rapidly. Also, each detector has been displayed irrespective thereof, and for example, even if the LED 121 to indicate the "WARNING" condition of one display part 101 and the LED 121 to indicate the "WARNING" condition of another display part 101 are lit, the context of these displays could not be grasped, and thus, the fire spreading direction or the like could not be grasped. Further, because the display is made by separate display part 101, the operation of confirming the threshold must be achieved for each display part 101 a plurality of times, and the operability was insufficient also in this point.

In addition, in the conventional detected information display system, only the concentration level was real-time displayed, and only the fact that the air-flow speed exceeds the specified threshold was displayed on the LED 123. Thus, the air-flow speed could not be real-time grasped, and even when a factor of troubles such as clogging of the sampling tube is generated, and the change of the air-flow speed which is a sign leading to a trouble is generated, there were no devices to know such a condition, and it was impossible to predict generation of such a trouble in advance by the monitoring service man, and to take an action in an early stage.

SUMMARY OF THE INVENTION

An object of the present invention, in order to solve the problems in the conventional detected information display system in such a fire detecting system, is to provide the detected information display system in the fire detecting system capable of rapidly grasping the maximum level of the detected physical quantity and the set values, and capable of achieving the display of a plurality of detectors in an integrated and related manner.

The present invention to solve the problems of a conventional detected information display system in a fire detecting system, is characterized in that a detected information display system in a fire detecting system which is equipped with a detector arranged in a warning area and a control panel to control the detector, and achieves a specified display on a physical quantity detected by the detector comprising, a conversion part to convert the physical quantity detected by the detector to a specified level in accordance with a prescribed standard, a conversion level storage part to store the level converted by the conversion part, an extraction part to extract the maximum level from the level stored in the conversion level storage part, and a display part which is equipped with level display parts corresponding to the specified level and displays the level converted by the conversion part and the maximum level extracted by the extraction part by keeping at least the level display part corresponding to the level converted by the conversion part and the level display part corresponding to the maximum level extracted by the extraction part in a visually different condition from each other.

In the present invention, the causes for generating an abnormal condition can be rapidly and easily elucidated because the maximum level is displayed on the display part in addition to the present detection level, and these levels can be easily grasped.

For example, when a high detection level is present before even if the present detection level is low, it can be imagined that some causes for an abnormality were temporarily generated in the past, and the warning area can be examined.

The present invention is characterized in that a detected information display system in a fire detecting system which is equipped with a detector arranged in a warning area and a control panel to control the detector, and achieves a specified display on a physical quantity detected by the detector comprising a conversion part to convert the physical quantity detected by the detector to a specified level in accordance with a prescribed standard, a threshold storage part to store an arbitrarily set threshold level of the specified levels as the threshold to judge whether or not the warning area is in a specified condition, and a display part which is equipped with level display parts corresponding to the specified level and displays the level converted by the conversion part and the threshold level stored in the threshold storage part by keeping at least the level display part corresponding to the level converted by the conversion part and the level display part corresponding to the threshold level stored by the threshold storage part in a visually different condition from each other.

In the present invention, the level set as the threshold is displayed on the display part in addition to the present detection level, this level can be easily grasped, and the setting of the threshold level can be rapidly and easily confirmed or changed.

In the present invention, a judgment part to judge whether or not the warning area is in a specified condition by comparing the level converted by the conversion part with the threshold level stored in the threshold storage part can be provided, and a judgment result display part to display the result of judgment by the judgment part can be provided on the display part.

In the present invention, the result of comparison with the threshold level can be displayed as the result of judgment, the result of judgment can be easily grasped, and troubles can be rapidly and easily restored.

The present invention is characterized in that a plurality of the detectors are provided, and a plurality sets of the level display parts corresponding to a plurality of the detectors are provided on the display part.

Alternatively, a plurality of the detectors may be provided, and a plurality sets of the judgment result display parts corresponding to a plurality of the detectors may be provided on the display part.

The present invention enables to collectively grasp the display of each detector in the same field of vision, and to easily grasp the whole detected information. For example, the maximum level of a plurality of detectors, the present concentration level, or the like can be easily compared and examined, and more detailed condition to elucidate the causes for abnormalities can be easily obtained.

The present invention is characterized in that a service condition storage part to store the level display part and the judgment result display part to be used in the display out of the level display parts and the judgment result display parts is provided, and that the display part determines the level display part and the judgment result display part to be used in the display so that the level display part and the judgment result display part are arranged in the specified direction along the time series based on the level display part and the judgment result display part stored in the service condition storage part.

In the present invention, the order of generation of the causes can be easily grasped and troubles can be rapidly and easily restored based on the display order. For example, the fire spreading direction or the like can be estimated based on the order of generation.

In the present invention, the temperature, the humidity, the quantity of light, or the like can be arbitrarily determined as necessary for the physical quantity to be detected by the detectors.

For example, the detectors may be smoke detectors to detect the smoke concentration, and the physical quantity may be the smoke concentration.

Alternatively, the detectors may be air-flow detectors to detect the air-flow speed, and the physical quantity may be the air-flow speed.

Further, the respective detection results of the smoke detectors and the air-flow detectors can be displayed by one display system, not limited to one physical quantity.

DESCRIPTION OF THE PREFERRED EMBODIMENT

An embodiment of the present invention will now be described with reference to the drawings.

Figure 1:
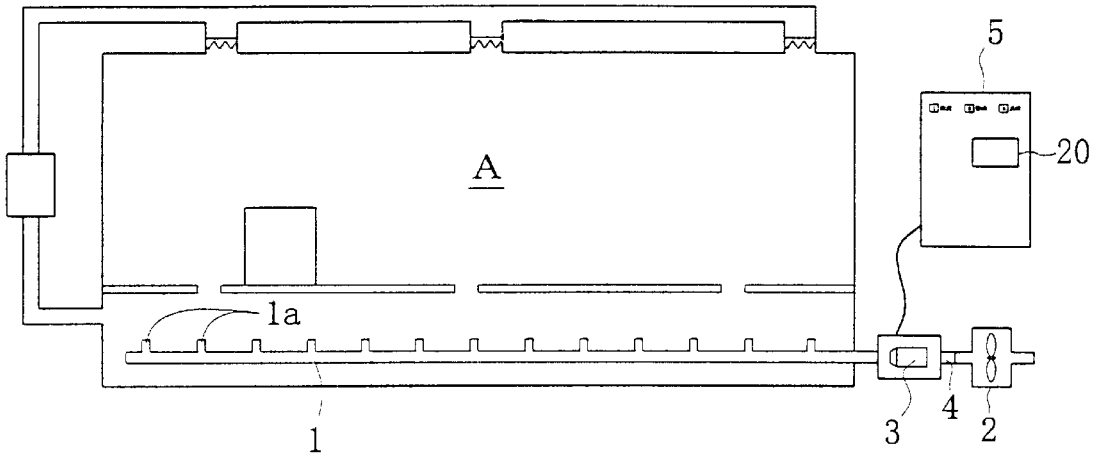
FIG. 1 is a schematic representation of a fire detecting system in a first embodiment of the present invention.

A fire detecting system of the present embodiment of FIG. 1 is constituted as a smoke detecting system using a sampling tube. The smoke detecting system comprises a long sampling tube 1 which is equipped in a warning area A to be monitored and provided with a plurality of suction holes 1*a*, a suction device 2 to suck the air in the warning area A through the sampling tube 1, a smoke detector 3 and an air-flow detector 4 (hereinafter, referred to as "detector" as necessary) provided in the vicinity of a base end part of the sampling tube 1, and a control panel 5 to control these detectors. The smoke detector 3 irradiates the laser beam on the air sucked through the sampling tube 1, and receives the scattered laser beam, and provides the analog output of the quantity of the received beam. The air-flow detector 4 provides the analog output of the speed of the air sucked through the sampling tube 1. However, the constitution and the output mode of the detectors can be arbitrarily changed.

Figure 3:
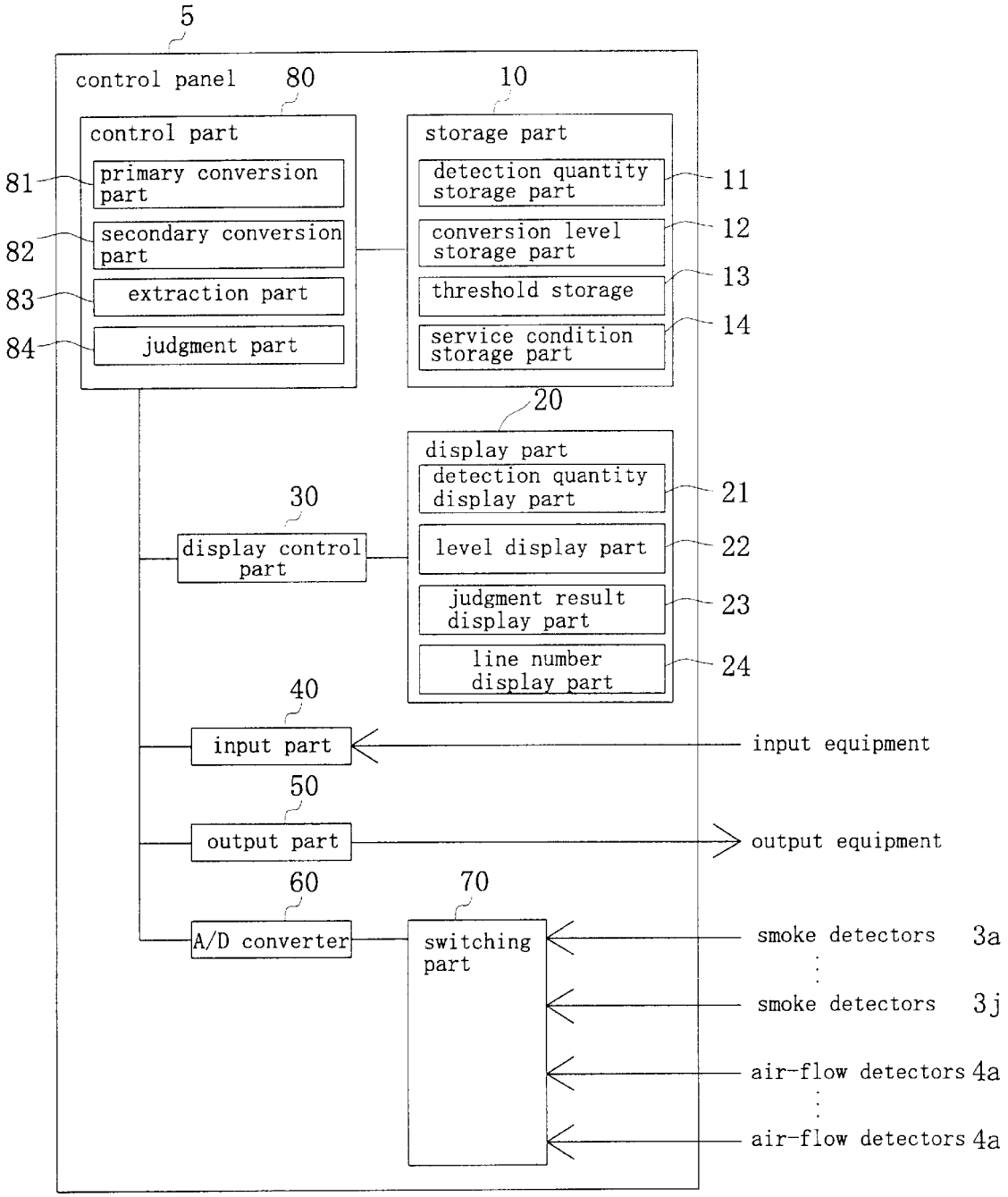
FIG. 3 is a block diagram of the control panel of FIG. 1.

A plurality of sampling tube 1 are provided though they are omitted in FIG. 1, and a plurality of smoke detectors 3 and air-flow detectors 4 are arranged corresponding thereto. A plurality of smoke detectors 3*a*–3*j* and air-flow detectors 4*a*–4*j* are intensively controlled by a control panel 5. The control panel 5 comprises a storage part 10, a display part 20, a display control part 30, an input part 40, an output part 50, an A/D converter 60, a switching part 70 and a control part 80 as illustrated in FIG. 3.

In the present embodiment, the analog outputs from the smoke detectors 3*a*–3*j* are converted in either numerical value (hereinafter, referred to as "the detection quantity") of 0 to 100, and further converted into either concentration level of 0 to 10. The smoke concentration includes three alarm conditions of "CAUTION", "WARNING", and "ABNORMAL", and three concentration levels are set as the threshold to judge the condition. In addition, the analog output from the air-flow detectors 4*a*–4*j* are converted into either numerical value (hereinafter, referred to as "detection quantity" as described above) of 0 to 100. The air-flow speed includes two alarm conditions of "low air-flow" and "high air-flow" relative to the normal speed, and two detection quantities are set as the threshold to judge the condition.

Out of the above-described components, the storage part 10 stores various kinds of information, and is provided with a detection quantity storage part 11 to store the detection quantity which is detected by a detector and converted by a below-described primary conversion part 81, a conversion level storage part 12 to store the level converted by a below-described secondary conversion part 82, a threshold storage part 13 to store the threshold inputted through an input device, and a service condition storage part 14 to store the information on the service condition of a plurality of level display parts 22 and a plurality of judgment result display part 23 which are described below. In addition, programs and data necessary for monitoring a fire are stored in the storage part 10. The detection quantity storage part 11 through the service condition storage part 14 of the storage part 10 are constituted in an integrated manner or in a separate manner with/from each other, and more specifically, in a ROM, a RAM and other arbitrary external storage devices, and the information unnecessary to write is stored in the ROM, and the other information is stored in the RAM or external storage devices.

Figure 2:
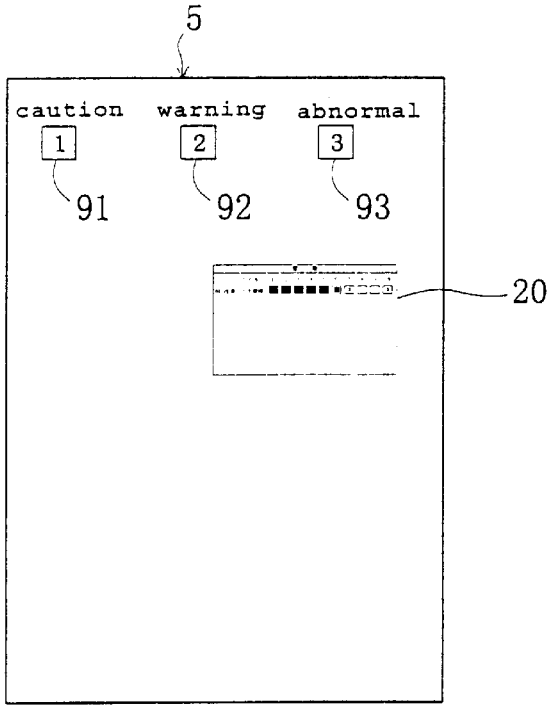
FIG. 2 is a front view of a control panel of FIG. 1.

The display part 20 is provided with a detection quantity display part 21 to display the detection quantity converted by the primary conversion part 81, a level display part 22 to display the level converted by the secondary conversion part 82, a judgment result display part 23 to display the judgment result of a below-described judgment part 84, and a line number display part 24 to display the line number of the detector. In addition, arbitrary format items or the like are displayed on the display part 20. This display part 20 is specifically constituted as one liquid crystal panel arranged in the front of a box body of the control panel 5 as illustrated in FIGS. 1 and 2, and the detection quantity display part 21 through the line number display part 24 are displayed at the specified position (different position for each screen) of the liquid crystal panel as necessary. Further, a display control part 30 controls the display part 20, and more specifically, is an LCD controller.

Also, the input part 40 is an input contact to receive the input signal from an input device to input or change the above-described threshold or an arbitrary device such as various switches (hereinafter, referred to as an "input device"). The output part 50 is an output contact to transmit the output signal to a printer, a speaker or an arbitrary device such as a suction device 2 or the like (hereinafter, referred to as an "output device").

The A/D converter 60 converts the analog signal outputted from the detector into the digital signal, and outputs it to the control part 80. The switching part 70 achieves the switching operation that only the analog signal from an arbitrary part of a plurality of detectors can be inputted in the A/D converter 60, and comprises, for example, a multiplexer.

The control part 80 controls the storage part 10, the display part 20, the display control part 30, the input part 40, the output part 50, the A/D converter 60, and the switching part 70. The control part 80 is provided with the primary conversion part 81 to convert the smoke concentration detected by the smoke detectors 3*a* to 3*j* and the air-flow speed detected by the air-flow detectors 4*a* to 4*j* into either numerical value of 0 to 100 in accordance with the prescribed standard, the secondary conversion part 82 to convert the detection quantity on the smoke concentration converted by the primary conversion part 81 into either concentration level of 1 to 10 in accordance with the prescribed standard, an extraction part 83 to extract the maximum concentration level as necessary from the concentration level stored in the conversion level storage part 12, and the judgment part 84 to judge whether or not a warning area A is in which alarm condition, i.e., in either alarm condition of caution, warning or abnormal by comparing the concentration level converted by the secondary conversion part 82 with the concentration level stored in the threshold storage part 13. The primary conversion part 81 to the judgment part 84 of the control part 80 comprise, and more specifically, electric circuits including ICs and programs in an integrated/separate manner with/from each other. The standard similar to the conventional one can be used as the prescribed standard in the primary conversion and the secondary conversion.

The display operation of the detected information in such a fire detecting system is described below.

Firstly, a power supply of the control panel 5 is closed, and when an initialization switch is operated, the detection quantity storage part 11, the conversion level storage part 12, the threshold storage part 13, and the service condition storage part 14 are initialized. When a monitoring service man inputs three concentration levels (each corresponding to "CAUTION", "WARNING" and "ABNORMAL") for the threshold of the smoke concentration, and two detection quantities (each corresponding to the "normal upper limit value", and the "normal lower limit value") as the threshold of the air-flow speed, these inputted concentration levels and detection quantities are stored in the threshold storage part 13. These concentration levels and detection quantities are determined for each detector according to the environment in which the detector is installed, arbitrarily in such a manner, for example, the concentration levels of the smoke detector 3*a* are 5, 8 and 10, the concentration levels of the smoke detector 3*b* are 4, 7 and 10, the detection quantities of the air-flow detector 4*a* are 20 and 80, and the detection quantities of the air-flow detector 4*b* are 15 and 75.

When the monitoring service man pushes a monitoring start button not indicated in the figure, the control signal to instruct the suction start is outputted to the suction device 2 through the output part 50 to start the fire monitoring. After the monitoring is started, only the letters "Monitoring Fire" are displayed on the display part 20 without lighting of a back light until the output signal from the judgment part 84 is outputted as described below. (The display is omitted in the figure.)

The polling signal is outputted from the control part 80 to the detector at the prescribed polling timing, the polling signal is successively called, and the analog signal to be outputted from each detector is successively received through the switching part 70, and successively converted into the digital signal through the A/D converter 60. The converted digital signal is converted into either detection quantity of 0 to 100 by the primary conversion part 81, and successively stored in the detection quantity storage part 11 in a classified manner for each detector. The detection quantities outputted from the smoke detectors 3*a* to 3*j* and converted into the primary conversion part 81 are further converted into either concentration level of 0 to 10 by the secondary conversion part 82, and successively stored in the conversion level storage part 12 for each detector. Conversion by the primary conversion part 81 and the secondary conversion part 82 is achieved by referring to a conversion table not indicated in the figure, but omitted here because its detail is well known. The address number of each detector is added to the signal to be outputted from the detector, and the detector is identified using the address number. The address number need not be always added to each detector.

Judgment is made by the judgment part 84 of the control part 80 every time such a primary conversion and a secondary conversion are achieved. That is, in the judgment part 84, the concentration level converted by the secondary conversion part 82 is compared with the concentration level stored as the threshold in the threshold storage part 13, and when the converted concentration level is not less than the stored concentration level, the signal indicating either of "CAUTION", "WARNING" or "ABNORMAL" is outputted. On the other hand, when the converted concentration level is lower than the stored minimum concentration level (the "CAUTION" level here), no signal is outputted. Further, in the judgment part 84, the detection quantity of the air-flow speed converted by the primary conversion part 81 or the secondary conversion part 82 is compared with the detection quantity stored as the threshold in the threshold storage part 13, and the signal indicating either "low air-flow" when the converted detection quantity is smaller than the stored minimum detection quantity which is deemed normal, or "high air-flow" when the converted detection quantity is larger than the maximum detection quantity which is deemed normal. On the other hand, if the converted detection quantity is smaller than the stored detection quantity, no signal is outputted.

Figure 4:
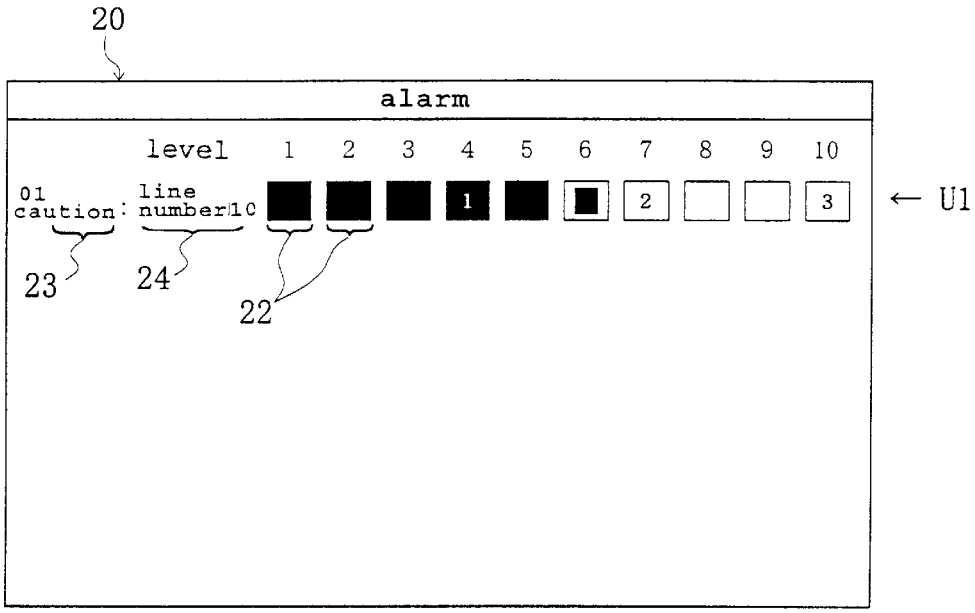
FIG. 4 is a front view of a display part of the control panel of FIG. 1 illustrating a screen to give an alarm.
Figure 7:
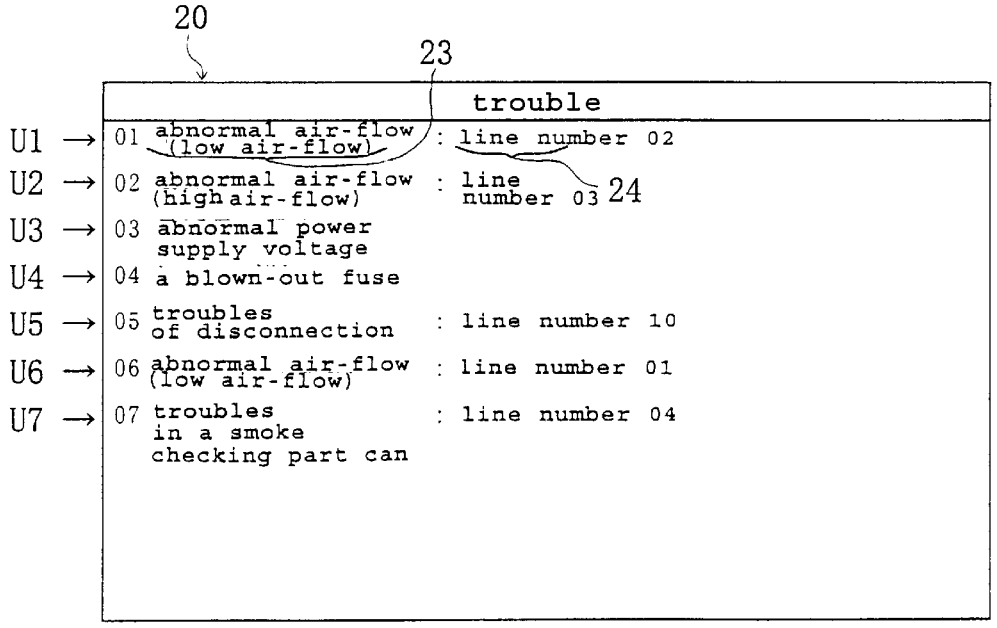
FIG. 7 is a front view of the display part of the control panel of FIG. 1 illustrating a screen to report a failure.

In the control part 80, the output signal from the judgment part 84 is constantly monitored, and when the signal indicating "CAUTION", "WARNING" or "ABNORMAL" is outputted, the display part 20 is controlled to display the screen indicated in FIG. 4. When the signal indicating "low air-flow" or "high air-flow" is outputted, the screen indicated in FIG. 7 is displayed. (The display in FIG. 4 or subsequent figures is attended with the lighting of the back light.)

The display indicated in FIG. 4 is described first. In FIG. 4, the letters "alarm" are displayed in the top center to indicate that the screen gives the alarm. The letters "Level 1 2 3 4 5 6 7 8 9 10" are displayed therebelow in the right-to-left direction in the figure. The judgment result display part 23, the line number display part 24, and the level display part 22 are provided therebelow in the right-to-left direction in the figure.

Here, the level display part 22 comprises a plurality of squares, and ten squares are continuously arranged in the right-to-left direction in the figure corresponding to the concentration levels 1 to 10 to be converted by the secondary conversion part 82. For example, the leftmost level display part 22 corresponds to the concentration level 1, the next level display part 22 corresponds to the concentration level 2, and the rightmost level display part 22 corresponds to the concentration level 10. (A plurality of level display parts 22 and the letters "1 2 3 . . . 10" are arranged in the upper and lower positions corresponding to each other.) Out of these level display parts 22, the level display part 22 corresponding to the concentration level not more than the concentration level converted by the secondary conversion part 82 is indicated in black, and the level display parts 22 corresponding to the other concentration level are indicated in white.

FIG. 4 indicates that the concentration level converted by the secondary conversion part 82 is 6. The level display part 22 may, of course, be indicated in other color. The shape of the level display part 22 is not limited to square, and may be triangular or polygonal. In addition, the level display part 22 may be indicated by a simple bar graph though it is indicated as a set of a plurality of square blocks.

In the screen indication in FIG. 4, the maximum concentration level out of the concentration levels stored in the conversion level storage part 12 is extracted by the extraction part 83 of the control part 80, and only the level display part 22 corresponding to the maximum extracted concentration level is bordered in white. FIG. 4 indicates that the maximum extracted concentration level is 6. Any display other than the above-described bordering may be accepted so long as the maximum concentration level can be easily understood.

In the screen indication of FIG. 4, the concentration level stored as the threshold in the threshold storage part 13 is read, and the numerals of [1], [2], [3] are displayed on the level display part 22 corresponding to the concentration level in the order from the smallest number upward of the concentration level. That is, 1 means "CAUTION", 2 means "WARNING", or 3 means "ABNORMAL". FIG. 4 indicates the concentration levels ("CAUTION", "WARNING" and "ABNORMAL") stored as the threshold are 4, 7 and 10, respectively.

The above-described numerals of [1], [2] and [3] are the same as those used in the display of representative indicating lamps 91–93 indicated in FIG. 2. These representative indicating lamps 91–93 are three indicating lamps provided on the front of a box body of the control panel 5, and the numerals of [1], [2] and [3] are affixed to each of the representative indicating lamps 91–93. Also, the letters of "CAUTION", the letters of "WARNING" and the letters of "ABNORMAL" are affixed in the vicinity of the representative indicating lamp 91 for "1", the representative indicating lamps 92 for "2", and the representative indicating lamp 93 for "3", respectively. The representative indicating lamp 91, the representative indicating lamp 92, or the representative indicating lamp 93 is lit by the signal to be outputted through the output part 50 when the concentration level corresponds to "CAUTION", "WARNING" or "ABNORMAL", respectively, by the judgment of the judgment part 84, and the alarm condition is notified to the monitoring service man. The visibility of the monitoring service man can be improved to enable rapider judgment by agreeing the display of the judgment result display part 23 with the display of the representative indicating lamps 91–93.

The line numbers of the smoke detectors 3*a* to 3*j* to have outputted the analog signal attributable to generation of the alarm are displayed on the line number display part 24. These line numbers are specified by referring to the table indicating the reference of the address number to the line number based on the address numbers of the smoke detectors 3*a* to 3*j* affixed to the analog signal. FIG. 4 indicates that the line number is 10.

Further, either letters of "CAUTION", "WARNING" or "ABNORMAL" are displayed on the judgment result display part 23 according to the judgment result of the judgment part 84. FIG. 4 indicates that the judgment result is "CAUTION".

Figure 5:
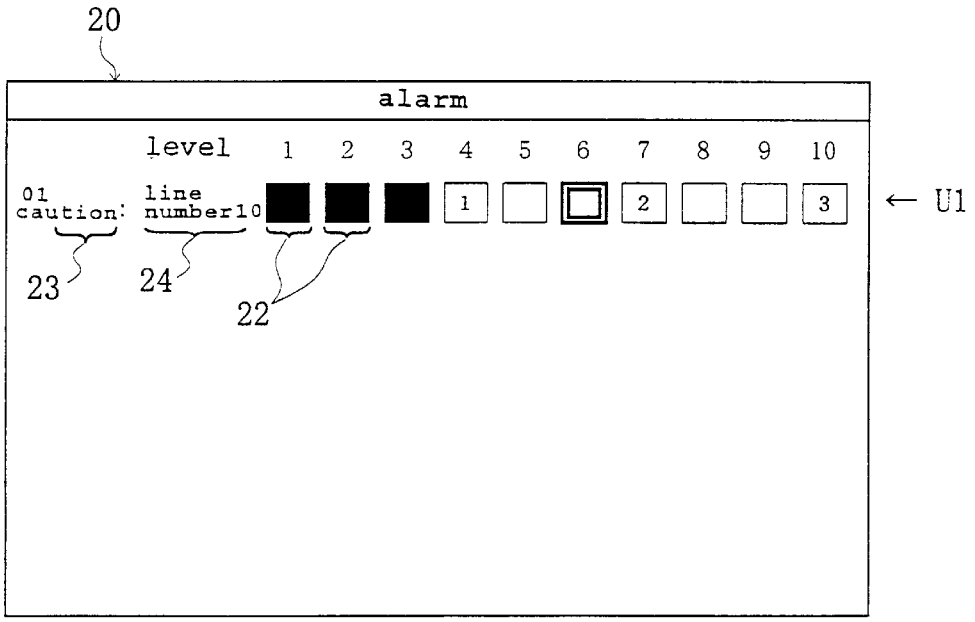
FIG. 5 is a front view of the display part of the control panel of FIG. 1 illustrating a screen after the situation is changed from the screen of FIG. 4.

Because the alarm screen itself of FIG. 4 is displayed until switched to other screens by manual operation, the monitoring service man can easily confirm its detail. The display content by the level display part 22 and the judgment result display part 23 is updated for each polling, and instantaneously changed according to the constantly changing content. For example, when the concentration level which is inputted and converted in the next polling from the smoke detector of the line number of 10 is 3, only the level display part 22 corresponding to the concentration levels 1 to 3 as illustrated in FIG. 5 is displayed in black, and the level display parts 22 corresponding to the other concentration level are indicated in white. Because the maximum concentration level to be extracted by the extraction part 83 is still 6, only the level display part 22 corresponding to the concentration level 6 is bordered in white. And because the judgment result of the judgment part 84 is still "CAUTION", the letters of "CAUTION" are displayed in the judgment result display part 23. However, when these maximum concentration levels and judgment results are changed, these display contents are also changed. Thus, the monitoring service man can constantly grasp the latest information, and make rapider judgment.

Figure 6:
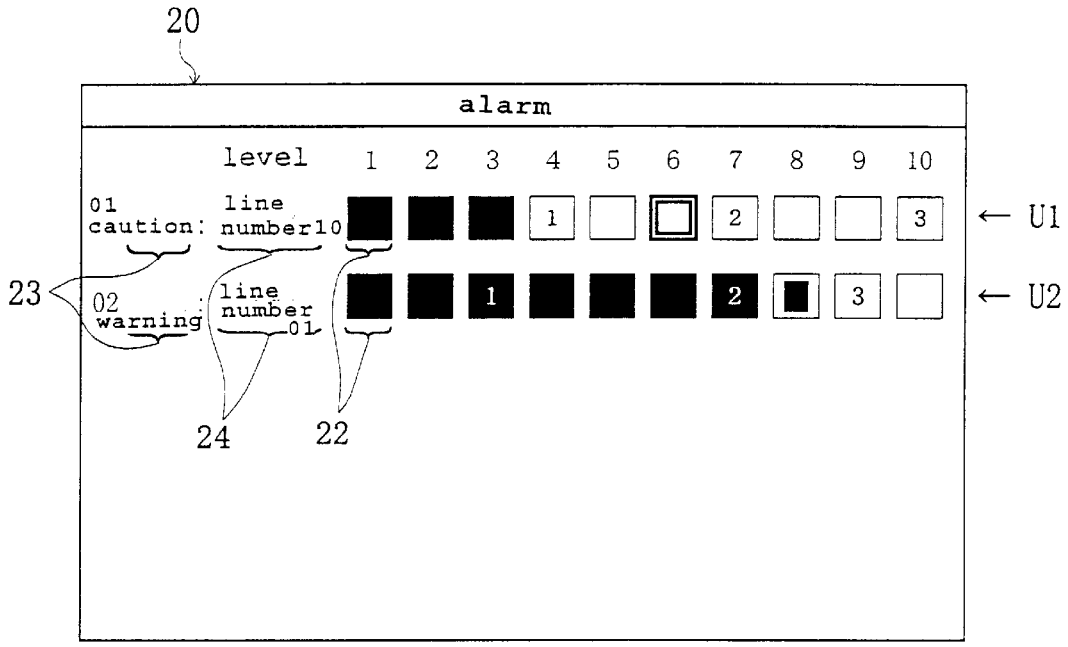
FIG. 6 is a front view of the display part of the control panel of FIG. 1 illustrating a screen in which a display unit is added to the screen of FIG. 5.

The display part 20 is constituted to simultaneously display a plurality of display units U, where one display unit U comprises the level display part 22, the line number display part 24 and the judgment result display part 23 as illustrated in FIG. 5. (In the present embodiment, ten sets of display units U1 to U10 can be simultaneously displayed.) When it is necessary to display other display units U according to the output from the judgment part 84 in a condition where one or more display units U are displayed on the display part 20, these display units U are arranged in the specified direction (the direction from the upper side to the lower side of the display part 20 in the present embodiment) along the time series so as to correspond to the order of receiving the output from the judgment part 84. FIG. 6 shows the condition where another display unit U2 is displayed in addition to the display unit U1 of FIG. 5.

Due to such a display control, the number of the display unit U used in the present display is stored and updated in the service condition storage part 14 of the storage part 10 every time the display of the display part 20 is updated. More specifically, flags No. 1 to No. 10 indicating the service condition of the display part 20 are prepared in the service condition storage part 14, each flag is allotted to the display unit U located on the upper side of the display part 20 in the order from the smallest number upward to indicate the display or non-display condition of the display unit U. For example, the condition where the first flag is set, indicates that the highest display unit U1 of the display part 20 is in the display condition, while the condition where the tenth flag is set indicates that the lowest display unit U10 of the display part 20 is in the display condition.

Every time a new display unit is displayed, the control part 80 refers to the storage content of the service condition storage part 14, the flag of the smallest number out of the non-set flags is set, and the display is achieved using the display unit U corresponding to the flag of the smallest number. For example, when the screen of FIG. 5 is displayed, only the first flag is set, the next flag is set when the display unit U is further added, and the display in FIG. 6 is achieved using the second display unit U2 from the top corresponding to the second flag. By arranging the display units U1 to U10 along the time series, the monitoring service man can understand the order of receiving the alarm output from the detector, and easily estimate the spreading direction of a fire, the cause of a fire, etc.

Then, the screen shown in FIG. 7 which is displayed when the signal indicating "low air-flow" or "high air-flow" from the judgment part 84 is described. In FIG. 7, the letters of "failure" are displayed in the top center in the display part 20 to indicate that this screen is a screen to notify the failure, and the judgment result display part 23 and the line number display part 24 are provided therebelow in the right-to-left direction. If the judgment result display part 23 and the line number display part 24 are deemed as one display unit U in FIG. 7, a plurality of display units U can be simultaneously displayed along the time series similar to FIG. 6. Seven display units U1 to U7 are displayed in FIG. 7.

And, similar to the case of FIG. 4, the line numbers of the air-flow detectors 4*a* to 4*j* to output the analog signal attributable to generation of the failure are displayed on the line number display part 24 of each display unit U. The line numbers are specified by referring to the table indicating the reference of the address numbers to the line numbers based on the address numbers of the air-flow detectors 4*a* to 4*j* affixed to the analog signal. But then, the address numbers need not be always affixed to each detector in identifying the line numbers. For example, the line number can also be specified by an in-line package switch on a circuit panel from the hardware viewpoint. This is true for the smoke detectors. The line number display part 24 of the highest display unit U1 in FIG. 7 indicates that the line number is 02. Similar to the case of FIG. 4, the letters of "abnormal air-flow (low air-flow)" in a case of "low air-flow", and "abnormal air-flow (high air-flow)" in a case of "high air-flow" are displayed, respectively, on the judgment result display part 23 as the judgment result of the judgment part 84. The judgment result display part 23 of the highest display unit U1 in FIG. 7 indicates that the judgment result is the low air-flow.

As described above, the display part 20 indicates not only the presence/absence of an abnormal air-flow but also the low air-flow or high air-flow at the same time, and the monitoring service man can grasp the details of the abnormality, and can estimate a cause for the failure and take a rapid action thereon. For example, it can be estimated that clogging of the sampling pipe 1 or an abnormality in the suction fan 2, etc. is generated in a case of the low air-flow, or fracture or the like of the sampling pipe 1 is generated in a case of the high air-flow.

In addition, in the screen for alarming a failure as illustrated in FIG. 7, the contents of the failure such as abnormal power supply voltage, a blown-out fuse, troubles of disconnection, and troubles in a smoke checking part can be displayed as respectively illustrated in the display units U3 to U5, and U7. These troubles can be detected by a detecting unit not shown in the figure in a similar manner to a conventional method. The display units U1 to U7 are arranged in the direction from an upper side to a lower side of the display part 20 corresponding to the order of generation of troubles in FIG. 7 similar to FIG. 6.

Figure 8:
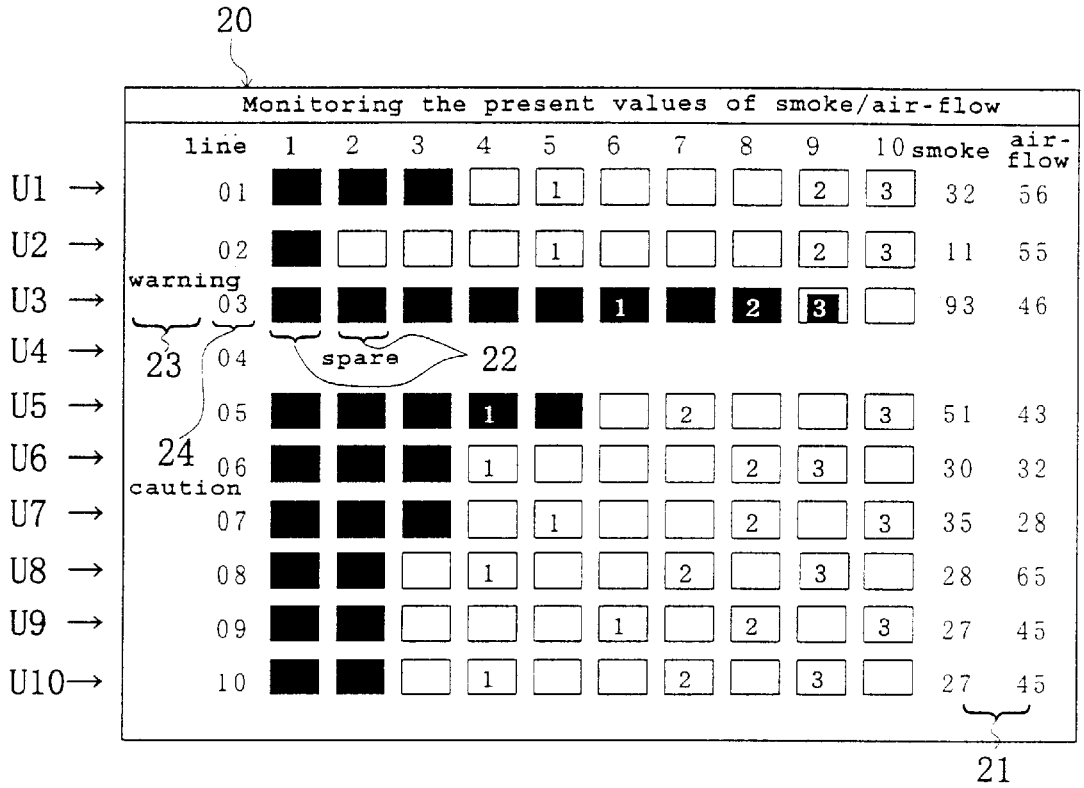
FIG. 8 is a front view of the display part of the control panel of FIG. 1 illustrating a monitor screen of the smoke concentration and the air-flow speed.
Figure 9:
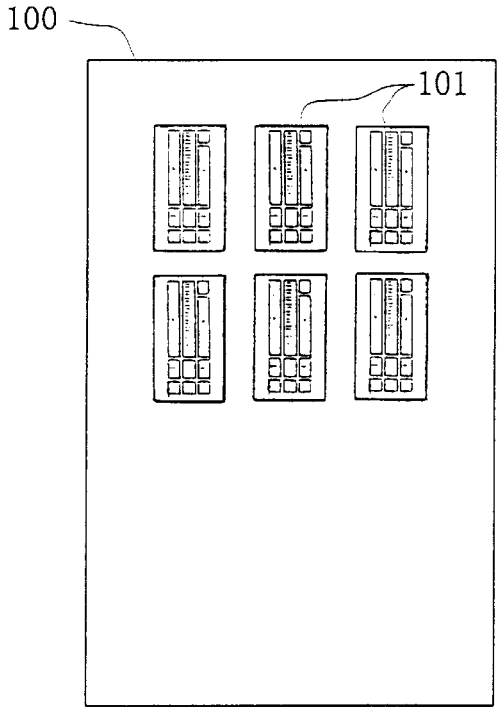
FIG. 9 is a front view of a control panel in a conventional fire detecting system.
Figure 10:
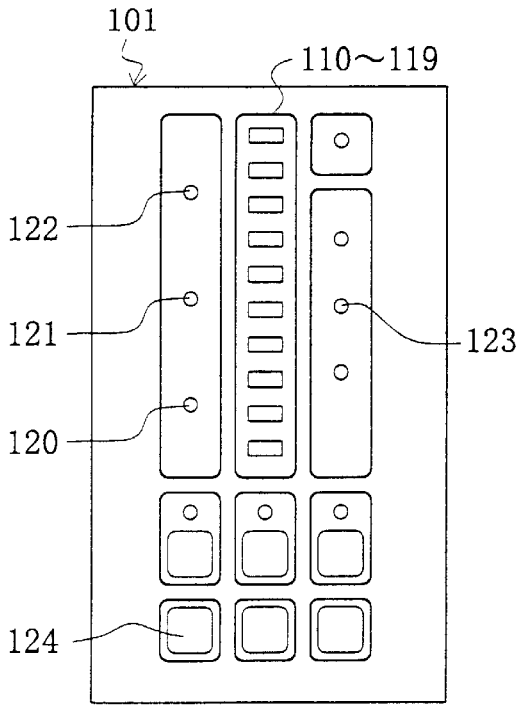
FIG. 10 is an enlarged view of the display part of the control panel of FIG. 9.

The display part 20 in FIGS. 4 to 7 described above, is capable of automatically achieving the display according to the judgment result of the judgment part 84, and when the concentration level or the like is desired to be confirmed irrespective of generation of an alarm or a trouble, the monitor screen shown in FIG. 8 can be displayed by the display part 20 by pressing a monitor display button not shown in the figure. In FIG. 8, the letters of "Monitoring the present values of smoke/air-flow" are displayed on the top center of the display part 20 in order to indicate that the present screen is a screen to alarm the present value of the smoke concentration and the air-flow speed, and the judgment result display part 23, the line number display part 24, the level display part 22, and the detection quantity display part 21 are provided therebelow in the right-to-left direction in the figure. If one display unit U in FIG. 8 comprises the judgment result display part 23, the line number display part 24, the level display part 22, and the detection quantity display part 21, a plurality of display units U can be simultaneously displayed for each line. Ten display units U1 to U10 are displayed in FIG. 8.

Here, the judgment result display part 23, the line number display part 24, and the level display part 22 are similar to the example described above. However, in the display part 20 of FIG. 8, the judgment result display part 23 and the level display part 22 display the judgment result on the smoke concentration, and the concentration level, but the air-flow speed is not displayed. The detection quantity display part 21 displays the detection quantity of the smoke concentration and the detection quantity of the air-flow speed stored in the detection quantity storage part 11.

For example, in the third display unit U3 from the top, "WARNING" is displayed on the judgment result display part 23 to show that the smoke concentration exceeds the concentration level set as the threshold for warning. Further, "03" is displayed on the line number display part 24 to show that the line number is 03. Still further, the ninth level display part 22 is displayed in black on the level display part 22, and the ninth level display part 22 is bordered in white to show that the maximum concentration level is 9. In addition, the numerals 1, 2 and 3 are displayed on the sixth, eighth and ninth level display parts 22, respectively to show that the concentration levels 6, 8 and 9 are respectively set as the threshold for three alarm conditions of "CAUTION", "WARNING" and "ABNORMAL". The relative quantities of "93" and "46" are displayed on the detection quantity display part 21 to show that the present detection quantity is 93 for the smoke concentration and 46 for the air-flow speed. The display contents by the judgment result display part 23, the level display part 22 and the detection quantity display part 21 are updated for each polling, and instantaneously changed according to the constantly changing contents. The present detected information can be constantly grasped irrespective of the presence/absence of alarms or troubles by the monitoring service man by providing the display part 20 to achieve the display.

One embodiment of the present invention is described above, but the present invention is not limited to the above-described embodiment, but may be carried out in various different embodiment in its technical scope, and these different embodiments are described below.

Firstly, in the embodiment, the fire detecting system is constituted as the smoke detecting system using the sampling tube, but may be applicable not only the display system of the detection system, but also the detected information display system of every fire detecting system to display the information on the physical quantity of the detector. Further, the detector may be those capable of detecting the physical quantity other than the smoke concentration or the air-flow speed. That means, the display system of the present invention not limited to the smoke concentration or the air-flow speed so long as it displays the information on the physical quantity.

In addition, the display part need not be provided on the control panel, but may be installed at an arbitrary part separate from the display panel, and further, for example, the level display part and the judgment result display part can be installed at separate parts from each other. The display part can naturally be composed of an arbitrary display device such as a plasma display, not a liquid crystal panel. In the above-described embodiment, the maximum concentration level is displayed by the bordering in white, and the concentration level of the threshold is displayed by the display of the numerals, but any mode of display may be acceptable so long as it can be visually discriminated from the level display. The level display part or the like to be displayed corresponding to the time series may be arranged in other directions than the direction from the upper side to the lower side, and for example, the direction from the left side to the right side may be acceptable. Further, keeping or non-keeping of the display contents of the detection quantity display part, the level display part or the judgment result display part, or keeping or non-keeping of each display screen illustrated in FIG. 4 may be performed in accordance with arbitrary standards. For example, the display of the level display part illustrated in FIGS. 4 to 8 may be kept without real-time updating until the monitoring service man clears it. Alternatively, each display screen illustrated in FIGS. 4 to 8 may be kept until cleared by the monitoring service man, or may be cleared when the causes for alarms or troubles are eliminated.

The information detected by the air-flow detector may be displayed in the same constitution as the information detected by the smoke detector. That is, in the above-described embodiment, only the smoke concentration is level-converted by the secondary conversion part and displayed on the level display part, but it may be displayed on the level display part by achieving the similar conversion to the air-flow speed.

What is claimed is:

1. A detected information display system in a fire detecting system which is equipped with a detector arranged in a warning area and a control panel to control said detector, and achieves a specified display on a physical quantity detected by said detector comprising:

a conversion part to convert the physical quantity detected by said detector to a specified level in accordance with a prescribed standard;

a conversion level storage part to store the level converted by said conversion part;

an extraction part to extract the maximum level from the level stored in said conversion level storage part; and a display part which is equipped with level display parts corresponding to said specified level and displays the level converted by said conversion part and the maximum level extracted by said extraction part by keeping at least the level display part corresponding to the level converted by said conversion part and the level display part corresponding to the maximum level extracted by said extraction part in a visually different condition from each other.

2. A detected information display system in a fire detecting system which is equipped with a detector arranged in a warning area and a control panel to control said detector, and achieves a specified display on a physical quantity detected by said detector comprising:

a conversion part to convert the physical quantity detected by said detector to a specified level in accordance with a prescribed standard;

a threshold storage part to store an arbitrarily set threshold level of said specified levels as the threshold to judge whether or not said warning area is in a specified condition; and a display part which is equipped with level display parts corresponding to said specified level and displays the level converted by said conversion part and the threshold level stored in said threshold storage part by keeping at least the level display part corresponding to the level converted by said conversion part and the level display part corresponding to the threshold level stored by said threshold storage part in a visually different condition from each other.

3. A detected information display system in a fire detecting system according to claim 1 or 2, wherein a plurality of said detectors are provided, and a plurality sets of said level display parts corresponding to a plurality of said detectors are provided on said display part.

4. A detected information display system in a fire detecting system according to claim 2, wherein a judgment part to judge whether or not said warning area is in a specified condition by comparing the level converted by said conversion part with the threshold level stored in said threshold storage part, and a judgment result display part to display the result of judgment by said judgment part is provided on said display part.

5. A detected information display system in a fire detecting system according to claim 4, wherein a plurality of said detectors are provided, and a plurality sets of said judgment result display parts corresponding to a plurality of said detectors are provided on said display part.

6. A detected information display system in a fire detecting system according to claim 5, wherein a service condition storage part to store the level display part and the judgment result display part to be used in the display out of said level display parts and said judgment result display parts are provided, and said display part determines the level display part and the judgment result display part to be used in the display so that said level display part and said judgment result display part are arranged in the specified direction along the time series.

7. A detected information display system in a fire detecting system according to claim 1 or 2, wherein said detectors are smoke detectors to detect the smoke concentration, and said physical quantity is the smoke concentration.

8. A detected information display system in a fire detecting system according to claim 1 or 2, wherein said detectors are air-flow detectors to detect the air-flow speed, and said physical quantity is the air-flow speed.

* * * * *